US007387466B2

(12) United States Patent
Irwin

(10) Patent No.: US 7,387,466 B2
(45) Date of Patent: Jun. 17, 2008

(54) CONCRETE PATTERN TAMPER HAVING ELASTOMERIC BODY AND NECK

(75) Inventor: Jeffery A. Irwin, 2560 Jason Ct., Oceanside, CA (US) 92056

(73) Assignees: Jeffery A. Irwin, Oceanside, CA (US); Proline Concrete Tools Inc, Oceanside, CA (US)

( * ) Notice: Subject to any disclaimer, the term of this patent is extended or adjusted under 35 U.S.C. 154(b) by 0 days.

(21) Appl. No.: 11/331,807

(22) Filed: Jan. 13, 2006

(65) Prior Publication Data

US 2007/0041787 A1 Feb. 22, 2007

Related U.S. Application Data

(63) Continuation-in-part of application No. 29/236,450, filed on Aug. 16, 2005, now Pat. No. Des. 531,863.

(51) Int. Cl.
*E01C 19/32* (2006.01)
*E01C 19/35* (2006.01)

(52) U.S. Cl. ..... 404/133.1; 404/133.05

(58) Field of Classification Search ..... 404/133.1, 404/93, 133.05

See application file for complete search history.

(56) References Cited

U.S. PATENT DOCUMENTS 583,287 A * 5/1897 Gardner ..... 101/406
636,077 A * 10/1899 Smith ..... 101/406
947,548 A * 1/1910 Lind ..... 404/133.1
1,085,505 A * 1/1914 Stafford ..... 404/133.1
2,232,410 A * 2/1941 Smith ..... 101/406
2,841,061 A * 7/1958 Starr ..... 404/133.1
2,870,696 A * 1/1959 Yoch ..... 404/133.1
3,775,018 A 11/1973 Barton
3,802,790 A 4/1974 Blackburn
3,887,293 A 6/1975 Bowman
3,910,738 A 10/1975 Chandler et al.
4,131,406 A 12/1978 Fresquez
4,135,840 A 1/1979 Puccini et al.

(Continued)

FOREIGN PATENT DOCUMENTS

JP 2061205 3/1990

OTHER PUBLICATIONS

Scwartz, Mel M.; Encyclopedia of Materials, Parts, and Finishes; 2002; 2nd Ed.; "Rubber" encyclopedia entry.*

*Primary Examiner*—Raymond W Addie
(74) *Attorney, Agent, or Firm*—Gordon & Rees LLP; Rudolf O. Siegesmund

(57) ABSTRACT

A tamper for imparting patterns through a die to a pliable surface, most commonly a newly poured concrete structure such as a walkway, is disclosed. In the tamper of this invention its base, including the integrated handle-receiving neck, is formed substantial entirely of an elastomeric material with a defined hardness, thus reducing or eliminating the severe physical shocks which are caused when a tamper strikes a die or a concrete surface at an off-line angle. The elastomer material must have a Durometer hardness in range of 50-95, preferably 70-95 and more preferably 85-95 as measured on the Shore A hardness scale. Numerous elastomers are suitable for use; polyurethane polymers are preferred. A single type of elastomer may be used for the entire base or two or more elastomers may be conjoined and assembled to form the base.

18 Claims, 3 Drawing Sheets

U.S. PATENT DOCUMENTS

| | | | | | |
|---|---|---|---|---|---|
| 4,231,677 | A | | 11/1980 | Roming | |
| 4,284,366 | A | * | 8/1981 | Lucik | 404/44 |
| 4,776,723 | A | | 10/1988 | Brimo | |
| 4,838,728 | A | * | 6/1989 | McKeever | 404/89 |
| 4,993,867 | A | | 2/1991 | Esow | |
| 5,061,172 | A | * | 10/1991 | Fennessy, Sr. | 425/385 |
| 5,271,690 | A | | 12/1993 | Fennessy, Sr. | |
| 5,447,752 | A | | 9/1995 | Cobb | |
| 5,487,656 | A | | 1/1996 | Kaitanjian | |
| 5,964,236 | A | * | 10/1999 | Berke | 135/87 |
| 6,595,768 | B1 | | 7/2003 | Hunsaker | |
| 6,779,945 | B2 | * | 8/2004 | Saffo, Sr. | 404/118 |
| 6,923,630 | B2 | | 8/2005 | Allen | |
| 2004/0159977 | A1 | | 8/2004 | Perfetto | |
| 2005/0093204 | A1 | | 5/2005 | Gregg | |

* cited by examiner

CONCRETE PATTERN TAMPER HAVING ELASTOMERIC BODY AND NECK

CROSS-REFERENCE TO RELATED APPLICATION

This application is a continuation-in-part of design patent application Ser. No. 29/236,450, filed on Aug. 16, 2005, entitled "TAMPER".

BACKGROUND OF THE INVENTION

1. Field of the Invention

The invention herein relates to apparatus for imparting decorative surface patterns to pliable structures, primarily concrete pavements and walls.

2. Background of the Invention

Imparting of decorative patterns to the surface of newly formed concrete structures such as patios, swimming pool decks, walkways, driveways, walls and the like is a well-established industry. In many installations the pattern is formed in a surface of the wet concrete body by rolling or tamping with a machine-operated embossing pattern die. However, in numerous other installations machine embossment is either not practical or not desired. In such installations the embossment is done by a worker using a hand-held tamper. The tamper may have the pattern embossing die mounted on it so that the worker directly embosses the surface, or there may be a sheet-like pattern die laid on the wet concrete surface, and the worker then uses the tamper to tamp the back of the die to emboss the die's pattern into the surface. In either case the die is constructed such that the pattern to be imparted to the surface is formed as protrusions extending outwardly from a surface of the die. The height of the protrusions determines the depth to which the pattern is imparted to (embossed into) the concrete surface.

Hand tampers have conventionally been made of a rigid material, formerly wood but most commonly now steel. FIG. 1 illustrates a typical commercial steel tamper 2. The tamper 2 consists of a base plate 4, usually braced with ribs 6, with an integrated rigid neck 8 into which an elongated handle 10 is inserted. The handle 10 is rigidly attached to the neck 8 either by screwing or welding the handle into the neck or by having the handle and base/neck formed integrally during manufacture. These rigid tampers are difficult for workers to use comfortably and can be damaging to the concrete surface in use. If the worker does not strike the concrete surface or pattern die with the tamper held precisely perpendicular to the surface or die, the tamper base will rotate to a horizontal position as it strikes the surface or die and will jerk the handle hard against the worker's hands. The impact is often sufficient to make the worker lose a grip on the handle. Simultaneously, as the base hits the surface/die the base can push into the surface more deeply at one edge than the other, thus making the embossment uneven. In some cases tamper manufacturers have coated the steel bases with a thin elastomeric or plastic layer but that has not significantly relieved the problems, particularly the problem of the handle's impact on the worker's hands and arms.

One attempt by the prior art to alleviate these problems with tampers is illustrated in FIG. 2. In this type of tamper 12 the base 14 is made partially or entirely of an elastomeric material into which is embedded a small metal plate 16. The handle 18 is attached to the metal plate 16 usually by a bolt or screw (not shown) or the handle and plate are formed integrally and the handle/plate assembly is embedded into the tamper base 14 when the base is moulded. This type of tamper has been found to be only minimally easier to use than the conventional steel tampers. Only minimal flexibility is imparted to the handle by the embedded plate structure, so there is still substantial impact to the worker's hands and arms if the tamper is not held exactly on-line when striking the surface or die. Further, if the striking is sufficiently off-line, there is a tendency for the handle/plate assembly to tear free of the elastomeric base, thus rendering both the handle and the base unusable.

It is evident that the hand/arm impact problems result in rapid worker fatigue when using hand tampers. This in turn significantly slows the progress of embossment jobs and/or requires that a contactor hire additional tamper workers so that the workers doing the tamping can be relieved frequently.

It is therefore an object of this invention to provide for a hand tamper having a structure with a degree of flexibility sufficient to reduce or eliminate the hand/arm impacts for workers using the tamper, reduce or avoid damage to concrete surfaces from off-line strikes of the tamper, and yet have sufficient stiffness and rigidity in the structure such that good imparting of the patterns to the concrete surface is obtained consistently and quickly.

BRIEF SUMMARY OF THE INVENTION

The invention herein is a novel tamper for imparting patterns through a die to a pliable surface, most commonly a newly poured concrete structure such as a walkway, patio, wall or the like. The tamper of this invention is unique in that its base, including the integrated handle-receiving neck, is formed substantial entirely of an elastomeric material with a defined hardness. The elastomeric material allows the contact portion and the neck, although integrated together into the base, to move independently. This independent movement, although small, is sufficient to enable the tamper to reduce and often eliminate the severe physical shocks and jerks which are present in prior art tampers when a tamper strikes a die or a concrete surface at an off-line angle (i.e., with the contact surface of the tamper not exactly parallel to the die or surface). The flexibility of this independent movement permitted by the elastomeric material thus greatly reduces the stresses and impacts transferred to the worker using the tamper and also reduces damage to the surface being patterned.

In the present invention the elastomer material must have a Durometer hardness in range of 50-95, preferably 70-95 and more preferably 85-95, as measured on the Shore A hardness scale. Numerous elastomers are suitable for use; polyurethane polymers are preferred. A single type of elastomer may be used for the entire base or two or more elastomers may be conjoined and assembled to form the base.

The tamper may itself have embossing means on the bottom contact surface of the body, but preferably has a flat bottom contact surface and is used to strike the outer side (back) of a separate embossing die sheet. The underside (front) of the die has the embossing structure from which the pattern is imparted to the pliable concrete surface when the die is struck by the tamper.

These and numerous other features and properties of the tamper of this invention will be described in more detail below.

DETAILED DESCRIPTION OF THE INVENTION

The tamper of the present invention is best understood by reference to FIGS. 3-7 of the drawings.

Figure 1:
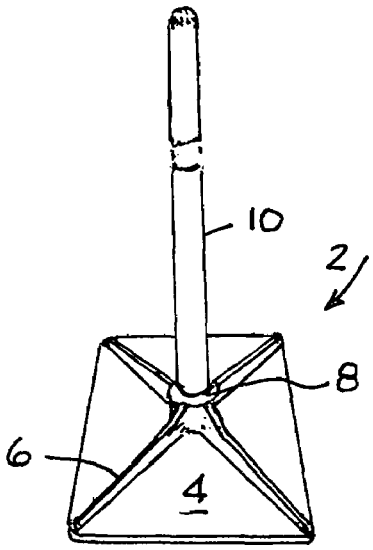
FIG. 1 PRIOR ART
FIG. 1 is a perspective view of a prior art tamping device.
Figure 2:
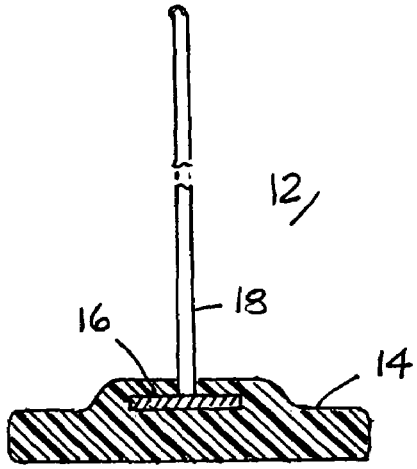
FIG. 2 PRIOR ART
FIG. 2 is an elevation view, partially in section, of another prior art tamping device.
Figure 3:
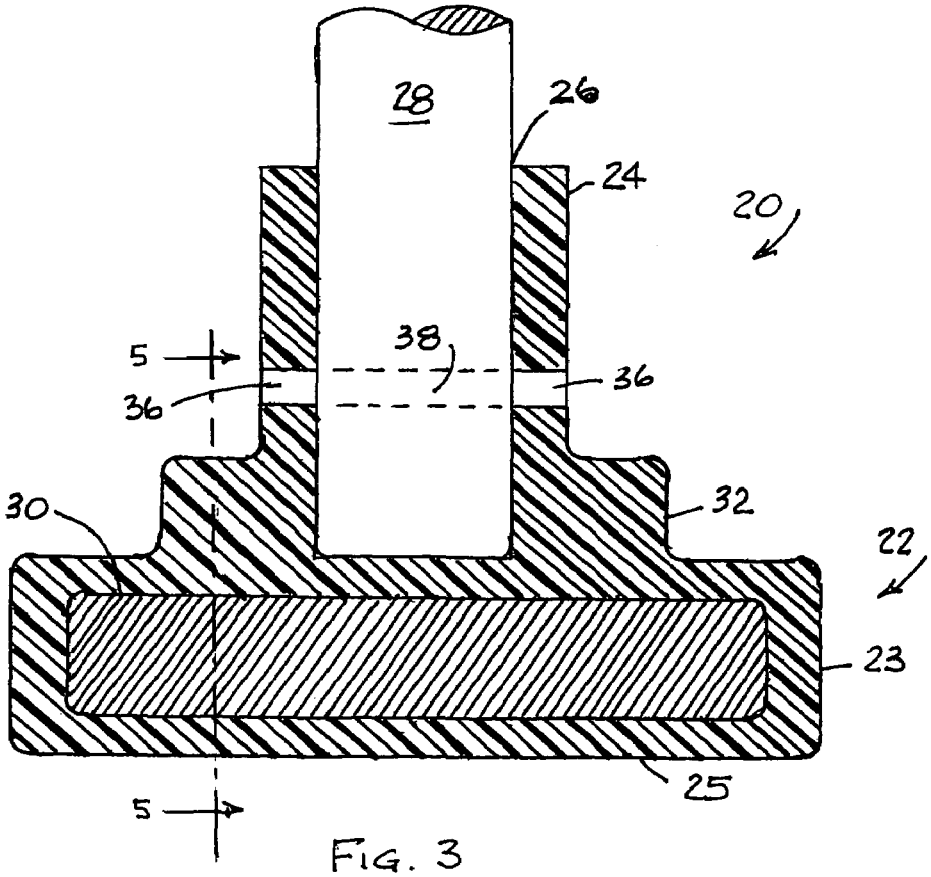
FIG. 3 is a centerline elevation view, partially in section, of a tamper of the present invention.
Figure 4:
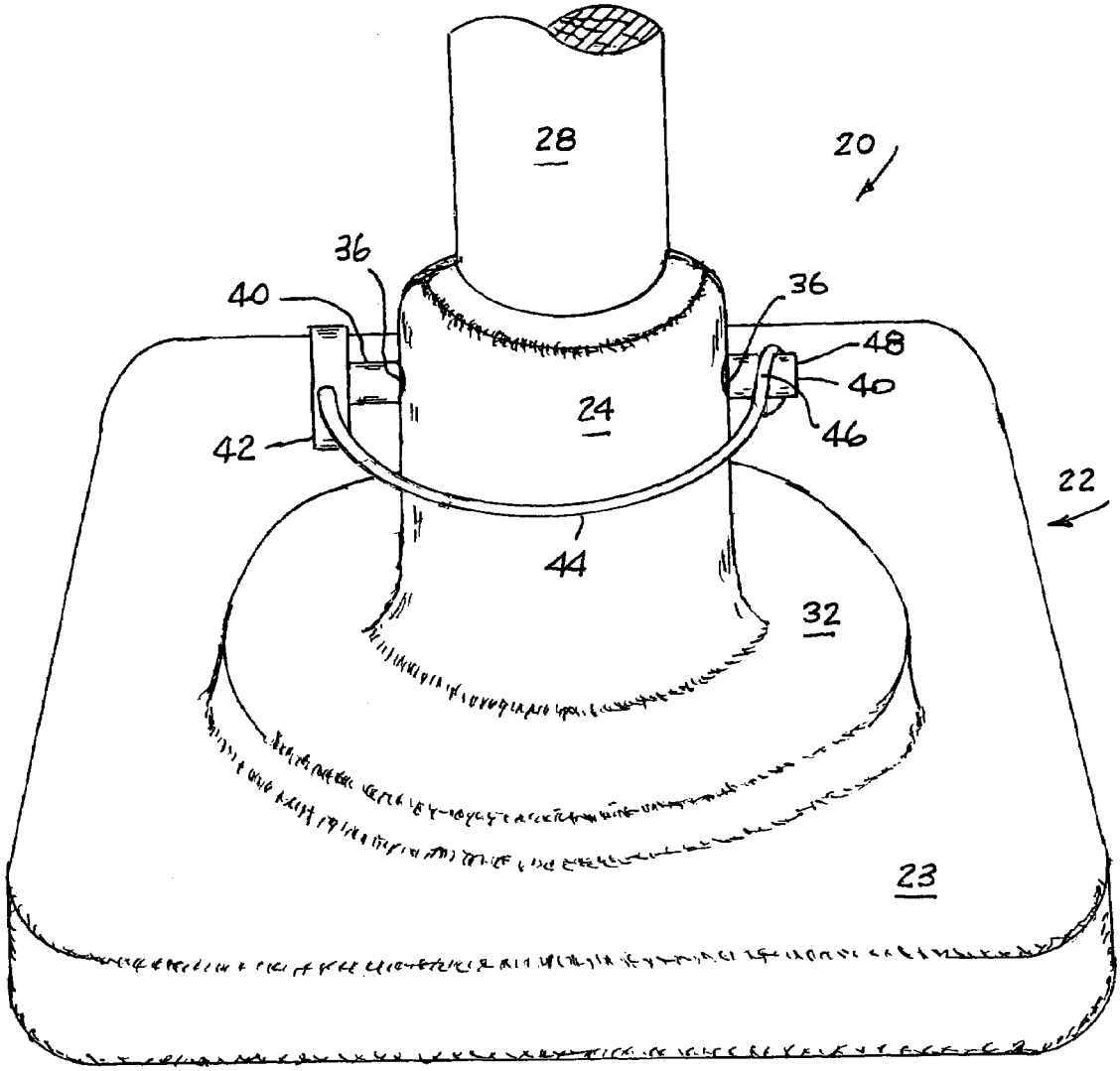
FIG. 4 is a perspective view from the front and above a tamper of the present invention, showing the device as normally assembled.

Considering first FIGS. 3 and 4, it will be seen that the tamper 20 comprises a base 22 which includes a neck 24 which has a deep recess 26 into which is seated an elongated handle 28. It is a critical feature of the present invention that the tamper base 22 including the neck 24 is formed substantially entirely of an elastomeric material of a stiffness sufficient to provide the appropriate combination of flexibility and rigidity to substantially reduce or eliminate the impact and damage tendencies of the prior art devices. The elastomeric material and its stiffness will be defined further below. The base 22 can be considered as having two and preferably three portions: a broad generally flat contact body 23 the bottom surface 25 of which makes the operative contact with the concrete 64 or with the die 62, an optional raised central portion 32 and a neck 24. The contact body 23 will be formed as a wide flat member, preferably rectangular or square with dimensions on the order of about 12"-16" [30-40 cm] on each long side and a thickness on the order of 2"-4" [5-10 cm]. The contact body 23 portion of the base 22 may be made larger or smaller as desired, or made in a circular, oval or other flat shape, but it has been found that the preferred dimensions and shapes normally result in the optimum combination of worker efficiency and speed of completion of embossing projects.

It is preferred that a stiff plate 30 be embedded in the interior of the contact body 23 portion of the base 22 to enhance the rigidity of the contact body 23 portion of the base and to add weight to enhance the force imparted by the tamper to the die during embossment. The plate may be made of metal such as steel or aluminum or of a heavy plastic material. The dimensions of the plate 30 are not critical, but commonly the plate 30 thickness will be on the order of ¼"-½" [6-12 mm]). There should be a sufficient thickness of elastomeric material surrounding and abutting the plate 30 that the use of the tamper does not cause the plate 30 to abrade and cut through the elastomeric material of the base 22. The plate 30 can conveniently be incorporated into the base 22 during moulding of the tamper, as will be described below, or an incision can be made in the base 22 after moulding, the plate 30 inserted and the incision closed and sealed, as by an adhesive. The latter technique is not preferred, however, as the incision, though sealed, remains as a potential point of weakness and failure of the tamper during prolonged use.

Figure 5:
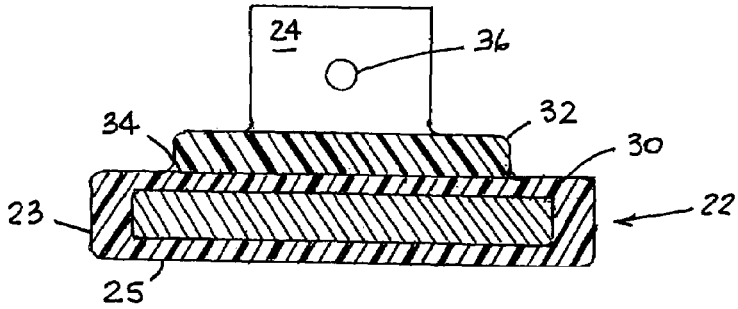
FIG. 5 is a cross-sectional view of the tamper of FIG. 3, taken on the line 5-5 in FIG. 3, and also illustrates the use of different elastomers in the device.

The tamper base 22 may have integrated into its structure a raised central portion 32. This portion enhances the attachment of handle 28 to the base 22 in that it allows for a deeper recess 26 and also provides a larger flexible volume of elastomeric material to absorb and reduce the impact effect of off-line strikes of the tamper. As illustrated in FIG. 5, the raised portion can be formed of a different elastomeric material than is used in the lower portion of the base 22. The two elastomers may be adhered during the moulding process, as described below, or they may be formed separately and then adhered by a suitable adhesive at the surface junction 34 of the two elastomers. Where there are two elastomers the neck 24 is more conveniently formed of the same elastomeric material as is the raised portion 32, although a base 22 of one elastomer may be formed with an extended neck 24 integrated with and extending upwardly from it, with the raised portion being formed of the other elastomer as an annulus through which the neck 24 extends, with the two elastomers then being adhesively bonded.

Extending upwardly from base 22 and/or raised portion 32 is neck 24. The neck is formed as a hollow cylinder usually having a height of about 3"-6" [7-15 cm]. The diameter will be determined by the diameter of the handle 28 (usually about 1"-1½" [25-35 mm]) plus twice the wall thickness of the neck (usually about ¼"-½" [6-12 mm]). The axial recess 26 will normally extend through the length of the neck 24 and into the raised portion 32 (if any) of base 22, but should not be so deep as to leave an insufficient thickness of elastomer between the bottom end of the handle 28 and the top surface of any internal plate 30. A hole 36 extends laterally through opposite sides of the wall of neck 24 with a corresponding co-axial hole 38 through handle 28 to allow securing of handle 28 to the tamper base 22. A securing pin 40 is removably inserted through holes 36/38 when the handle 28 is inserted into the recess 26 to lock the handle 28 into the recess 26. The pin 40 has a head 42 on one end to prevent the pin 40 being pushed through the holes 36/38. Attached to head 42 is one end of an elongated wire 44 used to retain pin 40 in place during use of the tamper. The wire 44 is sufficiently long to loop halfway around the neck 24 and has at its opposite end a loop 46 which fits over the end 48 of pin 40 opposite from the head 42. The wire 44 is a spring wire which is sufficiently rigid to maintain its curved shape but has a small amount of flexibility to enable it to be stretched to allow the loop 46 to pass over the end 48 of pin 40 and then spring back toward neck 24 to prevent loop 46 from falling off of pin 40 when the tamper is in use.

The handle 28 is conventional and may be of any convenient material, such as wood, plastic, hard elastomer or metal.

The elastomeric material or materials used for the base 22, raised portion 32 and neck 24 of the tamper may be of any convenient natural or synthetic rubber or other elastomer. Elastomers are well-known, extensively described in the literature and widely available commercially. Typical of the suitable materials are polyurethanes, styrene-butadiene copolymers, cross-linked rubbers and butyl rubbers, of which the polyurethane polymers are preferred. It has been found that to have the requisite combination of stiffness and flexibility to be effective in the products of this invention an elastomeric material must have a Durometer hardness in the range of 50-95, preferably 70-95 and more preferably 85-95, as measured on the Shore A scale. Those skilled in the art will readily be able to select suitable elastomers having acceptable hardnesses from the many commercial products available; polyurethane polymers of Shore Durometer A hardness of 85-95 which are commercially available from Innovative Polymer Systems (Rancho Cucamonga, Calif.) have been found to be quite satisfactory.

Figure 6:
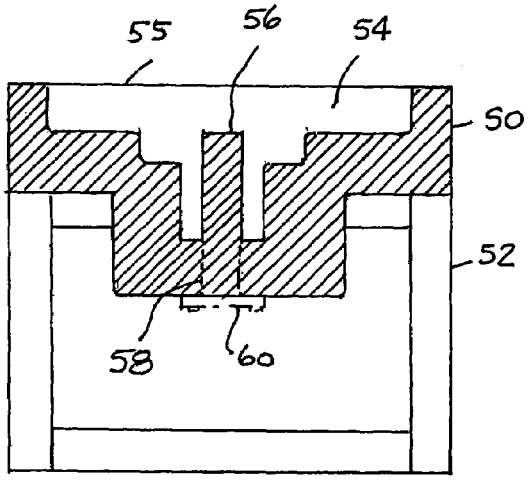
FIG. 6 is an elevation view, partially in section, of a mould useful in the manufacture of the tamper of this invention.

The tamper of the present invention is most conveniently made by moulding of the elastomeric material. FIG. 6 illustrates in cross-section a typical mould which can be used for this process. The mould 50 is mounted on a support structure 52 which is sufficiently sturdy to support the weight of the mould 50, the quantity of elastomeric material, and any plate 30 which is to be integrated into the product. An open wood structure of dimensional lumber framing has been found satisfactory. The inner surface of the cavity 54 is of course the "negative" of the outer surface of the base 22, with the open top 55 of the cavity 54 bordering the surface of liquid elastomer poured into the cavity which cures to form the bottom contact surface 25 of the tamper. Within the mould cavity 54 is a central plug 56 which serves to mould the recess 26 in neck 24. In FIG. 6 the plug 56 is illustrated as being integral with the rest of the mould body 50. However, as an alternative the mould body 50 may have a hole 58 formed in it through which a separate plug 56 can be inserted, to allow for moulding of tamper bases with different diameters of recesses 26. Such removable plugs 56 may be secured for use in any convenient way, such as by being screwed into hole 58 using cooperating threads on the hole 58 and plug 56, or by having a small plate attached to one end of plug 56 with the plate being bolted or screwed to the underside of mould body 50 as illustrated at 60.

The tamper base is then formed in a conventional moulding procedure by pouring the elastomeric material into the mould cavity 54 and curing the material to the requisite Durometer hardness by known means, commonly thermally or by inclusion in the poured material of chemical curing catalysts. If a plate 30 is to be incorporated it can be laid into the mould at the appropriate point in the pouring process. Similarly, if there are to be two elastomers used, they can be poured in and cured sequentially in any convenient known manner. All such moulding techniques and procedures are well known to those skilled in the art and do not need further elaboration here.

It is preferred that edges and corners of the base 22 be slightly rounded (radiused) as illustrated in the Figures, to prevent undue tearing or abrading of the elastomeric materials and to lessen the formation of extraneous grooves or lines in the pliable surface. Such rounding is easily accomplished during moulding, since mould cavities are normally formed with radiused corners and joints to facilitate material flow within the mould and avoid gaps in the moulded bodies. To the extent that such rounding does not occur automatically by moulding, corners or edges may if desired be rounded manually as by routing, planing, sanding, thermal melting or similar techniques well known to those skilled in the art.

Figure 7:
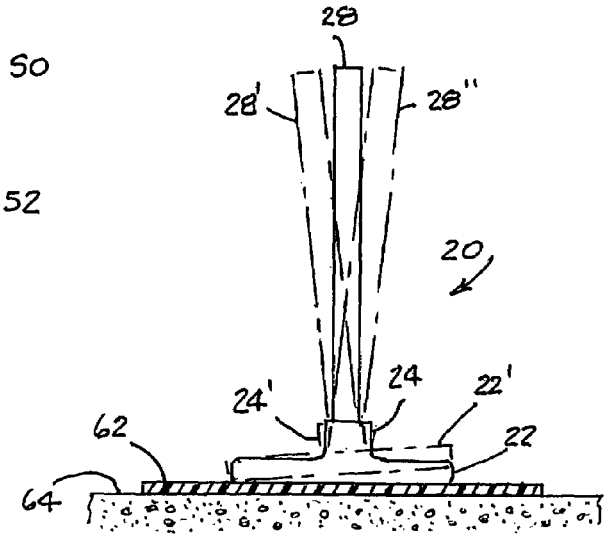
FIG. 7 is a diagrammatic elevation view illustrating the flexible properties of the tamper of the present invention.

FIG. 7 illustrates graphically the unique properties of the present invention. In FIG. 7 the tamper 20 is illustrated as being used to emboss a surface pattern into a newly laid concrete structure 64, such as a patio or walkway, using a conventional pattern die 62. The industry practice is for a worker to place the die 62 on the concrete 64 with the pattern side of the die 62 facing downward where the pattern is to be embossed, and then press or pound the tamper 20 onto the back side of the die 62 to force the pattern structure of the die into the concrete surface. Once the pattern is embossed and the concrete surface is sufficiently stable to maintain the embossed pattern, the die 62 is removed, cleaned and can be reused. It is common to use a number of abutting dies simultaneously to enable a large-scale pattern to be embossed over a wide surface area of the concrete 64 at one time, by having one worker repeatedly tamp all of the dies in rapid sequence or by having several workers tamp individual dies or groups of dies. In each case, however, the tamping procedure is the same. The worker will raise the tamper 20 above the outward (non-pattern) side of the die 62 and bring it down to strike the die and force the opposite pattern side into the pliable concrete surface 64. In order for the pattern to be properly transferred to the concrete surface, the tamper base 22 should be parallel to the back of the die 62 when it strikes the die, which means that the tamper handle 28 should be perpendicular to the die 62 and concrete surface 64 as the tamper descends. However, too often the worker does not hold the handle 28 exactly perpendicular to the die and concrete surface when tamping, as illustrated by examples of different handle positions indicated at 28' and 28". This causes the base 22 to strike the die 62 at an angle as illustrated at 22' (corresponding to handle position 28'). In the prior art tampers this mis-alignment or off-line striking necessarily causes the handle—being rigidly attached to the base—to suddenly jerk from, for instance, position 28' to position 28 as the base 22 pivots from position 22' to position 22 upon striking the die 62 with the concrete surface 64 underneath. This sudden jerking action at the minimum imparts a sharp impact to the worker's hands and arms, causing discomfort to the worker and stress to the worker's arm and hand muscles and joints. Not infrequently the jerk is sufficiently strong to rip the handle 28 out of the worker's grip, again causing discomfort and stress, and often also causing damage to the tamper, the die and/or the concrete surface as the handle and tamper moved or fell. Even if there is no immediate injury to the worker or the die or concrete, such jerking actions, repeated numerous times, result over time in chronic discomfort to the worker.

In the present tamper, however, these problems and dangerous situations are substantially reduced or eliminated by the flexibility of the elastomeric neck 24 of the tamper integrated elastomeric structure of the base 22. When the worker brings a tamper 20 of the present invention downward to strike the die 62, being slightly off-line is readily compensated for. The flexible neck 24 allows the handle 28 and the base 22 to move independently, such that the base 22 can self-level as it contacts the die even while the handle 28 is in the off-line angled position (such as 28' or 28"), so that the handle 28 is not forced to move in the worker's grip by the self-leveling of the base 22. The worker thus is not subjected to sudden jerking of the handle 28 and resultant stress to hands and arms. Rather as the base 22 self-levels, the worker can in a smooth, controlled and easy movement bring the handle 28 to a position perpendicular to the die by movement of the flexible neck from position 24' to position 24 so that the tamper can force the die pattern properly into the concrete surface 64. Over the course of a work period the worker thus becomes much less fatigued and can maintain a high level of performance throughout the work period. Further, the patterns embossed are of much more consistent quality, due to the self-leveling ability of the tamper base 22. These properties and results have not previously been available in any of the prior art products.

Throughout this specification the pliable surface to which the pattern is to be imparted has been described as "concrete." It is to be understood, however, that the tamper of this invention and its associated die or dies may be used to impart a pattern to any pliable surface which can retain the imparted pattern. While bodies and structures made of conventional concrete materials are the most common subjects for such patterning (while they are newly poured and still pliable), the use of the tamper invention herein is not limited to working of concrete. Other durable materials which can be embossed during a pliable stage, such as various terrazzo, asphalt, hard clay, moulded polymeric or mineral particulate boards and the like are also equivalent to concrete for the purposes of this invention. Therefore the term "concrete" is used herein for brevity, and the applications of the tamper of this invention are not to be limited solely to use with conventional concrete materials but may be used with any equivalent pliable surface material where substantially equivalent imparting of patterns is desired. In addition, it will be recognized that the tamper may be used, as is common in laying of concrete, to tamp the dirt onto which the concrete (or base layer beneath the concrete) is to be laid.

It will be evident that there are numerous other embodiments of the tamper of this invention which are not expressly discussed above but are clearly within the scope and spirit of the invention. The above description is therefore to be considered exemplary only, and the actual scope of the invention is to be determined solely from the appended claims.

I claim:

1. A tamper for imparting patterns into a pliable surface comprising a base including an elongated neck having a hollow cylindrical recess for receiving a generally cylindrical handle, said handle adapted for a standing person to strike an embossing die with the tamper for imparting patterns into a pliable surface, and said base and said neck being formed substantially entirely of a flexible elastomeric material having a Shore A Durometer hardness in the range of 50-95.

2. A tamper as in claim 1 wherein said elastomeric material has a Shore A Durometer hardness in the range of 70-95.

3. A tamper as in claim 2 wherein said elastomeric material has a Shore A Durometer hardness in the range of 85-95.

4. A tamper as in claim 1 further comprising said member being a stiff plate.

5. A tamper as in claim 1 wherein said elastomeric material comprises an assemblage of a plurality of elastorners.

6. A tamper as in claim 5 wherein said assemblage comprises individual elastomers disposed separately within said base in abutting and conjoined relationship.

7. A tamper as in claim 1 further comprising securing means in said neck for securing within said neck a handle received in said recess.

8. A tamper as in claim 7 wherein said handle has an aperture therethrough and said securing means comprises an aperture in a wall of said neck which aligns with said aperture in said handle and a pin removably extending through thus-aligned apertures.

9. A tamper as in claim 8 further comprising retaining means on said pin to releasably retain said pin disposed through said thus-aligned apertures.

10. A tamper as in claim 1 wherein said elastomeric material comprises a polyurethane polymer.

11. A tamper as in claim 1 wherein said base comprises a generally flat contact body and said neck.

12. A tamper as in claim 11 wherein said base comprises said generally flat contact body and said neck and disposed therebetween a central raised portion abutting both.

13. A tamper as in claim 12 further comprising said contact body and said central raised portion being formed of different elastomers which are conjoined at an abutting surface.

14. A mould for formation of said tamper as in claim 1, said mould comprising a cavity having a boundary surface configuration which is a negative of a surface configuration of said tamper base.

15. A mould as in claim 14 further comprising a plug having a surface configuration which is a negative of an inner surface configuration of said recess.

16. A mould as in claim 15 further comprising said plug being removable from said mould.

17. Apparatus for imparting a pattern to a pliable surface comprising a tamper as in claim 1 and a die having a transferable pattern incorporated therein, said die being placeable against said surface, whereby when said die is so placed and struck by said tamper, said pattern is imparted to said surface.

18. Apparatus as in claim 17 wherein said pattern is incorporated into said die by a surface of said die having said pattern formed as protrusions extending from said surface.

* * * * *